US008690291B2

(12) United States Patent
Moriwaki

(10) Patent No.: US 8,690,291 B2
(45) Date of Patent: Apr. 8, 2014

(54) IMAGE FORMING APPARATUS

(71) Applicant: Yuta Moriwaki, Kanagawa (JP)

(72) Inventor: Yuta Moriwaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/743,825

(22) Filed: Jan. 17, 2013

(65) Prior Publication Data

US 2013/0194346 A1 Aug. 1, 2013

(30) Foreign Application Priority Data

Jan. 31, 2012 (JP) ..... 2012-018352

(51) Int. Cl.
*B41J 2/165* (2006.01)

(52) U.S. Cl.
USPC ..... 347/33; 347/34

(58) Field of Classification Search
USPC ..... 347/33, 34
See application file for complete search history.

(56) References Cited

U.S. PATENT DOCUMENTS 5,381,169 A * 1/1995 Arai et al. ..... 347/33
2011/0080445 A1* 4/2011 Shimizu et al. ..... 347/31

FOREIGN PATENT DOCUMENTS

| | | | | |
|---|---|---|---|---|
| JP | 9-254401 | | 9/1997 | |
| JP | 2007-210254 | | 8/2007 | |
| JP | 4186557 | | 11/2008 | |
| JP | 2010-46962 | | 3/2010 | |
| JP | 2012-35498 | | 2/2012 | |
| JP | 2012-56148 | | 3/2012 | |
| JP | 2012-183664 | * | 9/2012 | ..... B41J 2/165 |

* cited by examiner

*Primary Examiner* — Henok Legesse
(74) *Attorney, Agent, or Firm* — Cooper & Dunham LLP

(57) ABSTRACT

An image forming apparatus includes: a recording head with multiple nozzles on a surface of the recording head to discharge droplets, the surface with the nozzles facing in a horizontal direction or in a direction leaning upward or downward with respect to the horizontal direction, a wiper to wipe the surface with the nozzles of the recording head from top to bottom, a guide member attached to the recording head at the lower end of the surface with the nozzles, to have contact with the wiper, and a cleaning member attached to a main body of the apparatus to clean the guide member.

5 Claims, 9 Drawing Sheets

23
24
124
124n
94
194
301
201
θ

IMAGE FORMING APPARATUS

BACKGROUND OF THE INVENTION

1. Field of the Invention

The invention is related to image forming apparatuses, especially, image forming apparatuses including droplet discharge recording heads.

2. Description of the Related Art

As an image forming apparatus used for printers, facsimile machines, copy machines, plotters, and combined machines of these, an inkjet recording device is known as an image forming apparatus adopting a liquid discharge recording method, for example, using ink droplet discharge recording heads.

An image forming apparatus adopting a liquid discharge method may have a maintenance and recovery mechanism, which may include a cap for capping the surface of nozzles of a recording head to maintain stability of discharge from the nozzles of the recording head, to avoid ink dehydration in the nozzles, and to prevent dust from intruding into the nozzles. The maintenance and recovery mechanism may also have a wiper, also called a wiper blade, a wiping blade, a blade, etc., to wipe the surface with the nozzles of the recording head to keep them clean. The maintenance and recovery mechanism executes, for example, recovery operations such as discharging ink with increased viscosity from the nozzles into the cap, then restoring a nozzle meniscus by wiping the surface of the nozzle with the wiper.

As a conventional image forming apparatus, the one having recording heads arranged vertically is known, as disclosed in Japanese Patent No. 4186557, or Japanese Laid-open Patent Publication No. 09-254401.

With the image forming apparatus having the surface with nozzles of the recording head arranged vertically, it is preferable that a wiper wipe off the surface with the nozzles from top to bottom.

However, when the wiper wipes the surface with the nozzles from top to bottom, there are problems. At the lower end of the wiped surface, wiped waste liquid may go around the lower end of the recording head to accumulate, or to drop, which may stain sheets.

SUMMARY OF THE INVENTION

It is a general object of at least one embodiment of the present invention to provide an image forming apparatus that substantially obviates one or more problems caused by the limitations and disadvantages of the related art.

Specifically, it is an object of one embodiment of the invention to prevent wiped waste liquid from going around the lower end of the recording head having the surface with the nozzles arranged vertically.

An image forming apparatus includes:

a recording head with multiple nozzles on a surface of the recording head to discharge droplets, the surface with the nozzles facing in a horizontal direction or in a direction leaning upward or downward with respect to the horizontal direction, a wiper to wipe the surface with the nozzles of the recording head from top to bottom, a guide member attached to the recording head at the lower end of the surface with the nozzles, to have contact with the wiper, and a cleaning member attached to a main unit of the apparatus to clean the guide member.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

Figure 1:
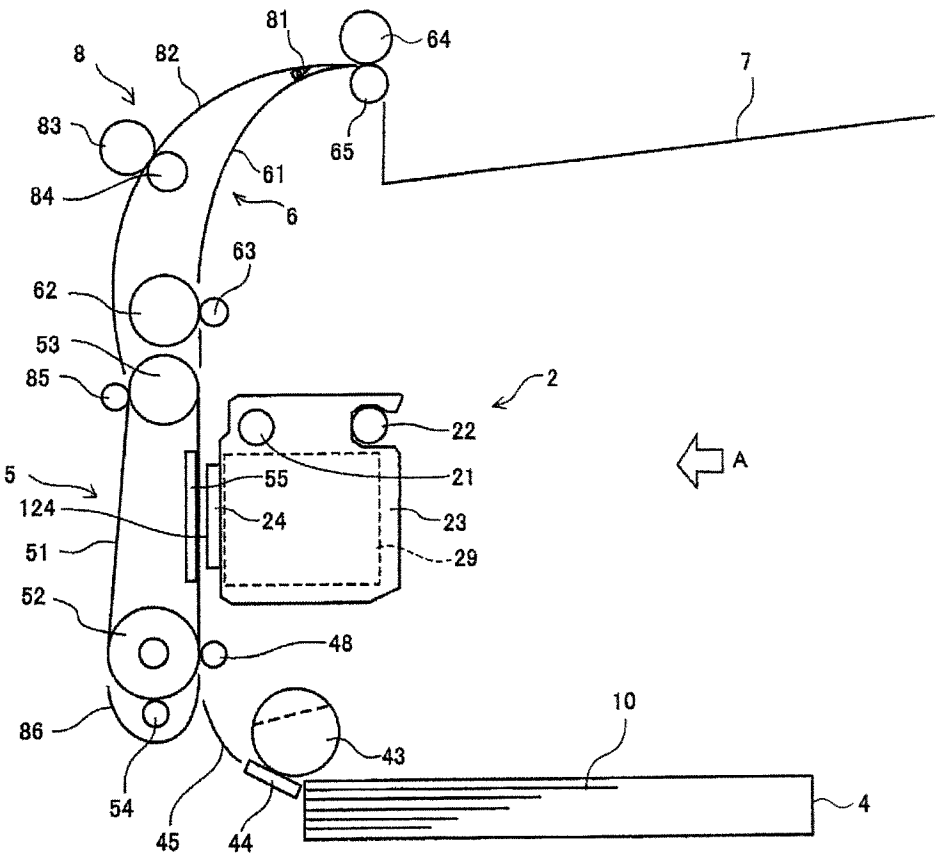
FIG. 1 is an explanatory side view of a mechanical section of an image forming apparatus according to an embodiment of the invention.
Figure 2:
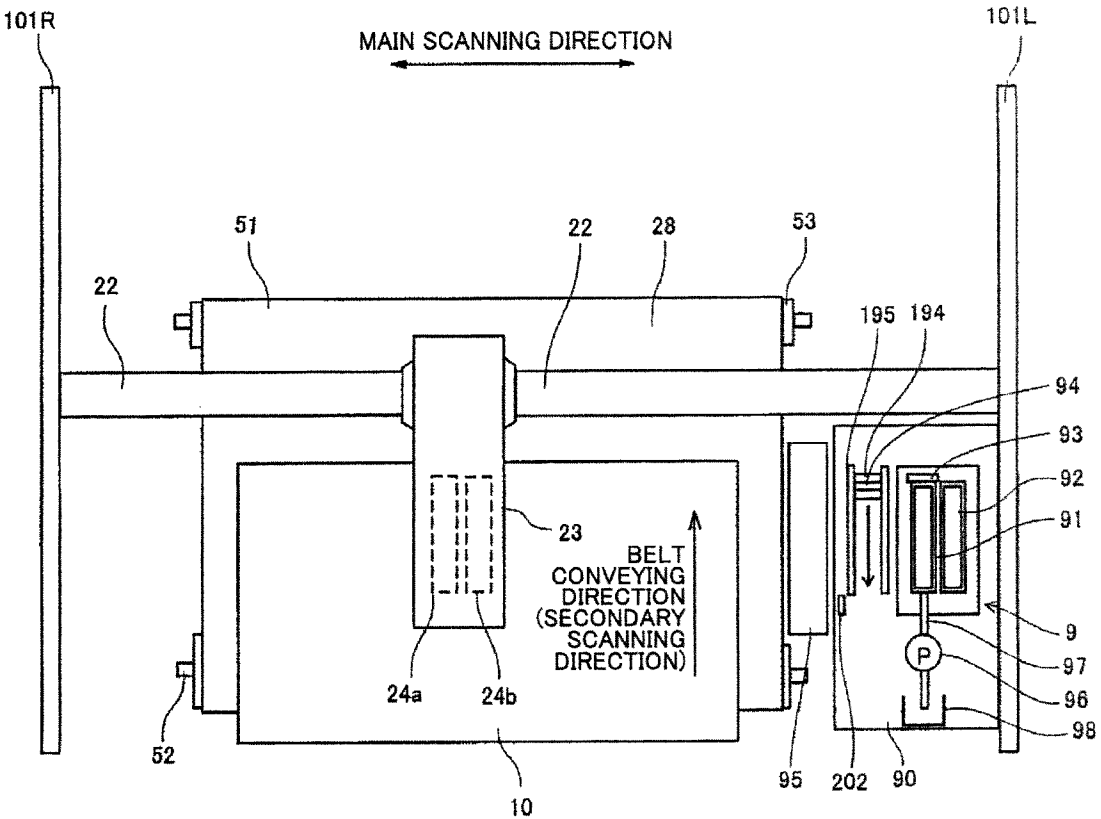
FIG. 2 is a schematic view of the mechanical section of FIG. 1 when viewing from a position "A", designated with an arrow in FIG. 1.

In the following, embodiments of the present invention will be described with reference to the accompanying drawings. First, an image forming apparatus according to embodiments of the invention will be explained with reference to FIG. 1 and FIG. 2. FIG. 1 is an explanatory side view of a mechanical section of the image forming apparatus. FIG. 2 is a schematic view of the mechanical section of FIG. 1 when viewing from a position "A", designated with an arrow in FIG. 1.

The image forming apparatus is a serial-type image forming apparatus including an image forming section 2, a conveyance mechanical section 5 and the like in a main body of the apparatus. The image forming apparatus also includes, under the main body, a paper feed tray 4 or a paper feed cassette or the like used as a paper feeding section to hold sheets of paper 10, which are recording media. The image forming apparatus feeds the sheets of paper 10 from the paper feed try 4, conveys the sheets of paper 10 with the conveyance mechanical section 5 vertically and intermittently, records prescribed images at the image forming section 2 by discharging droplets horizontally, conveys the sheets of paper 10 on which the images have been formed upward with a paper ejecting section 6, and ejects the sheets of paper 10 into a paper output tray 7 attached at an upper part of the main body of the apparatus.

When executing duplex printing, the image forming apparatus prints a surface of the sheet 10 as above, then feeds the sheet 10 from the paper ejecting section 6 into a flipping section 8, conveys the sheet 10 with the conveyance mechanical section 5 in a reverse direction, or downward, flips the sheet 10 to make the reverse side of the sheet 10 printable, feeds the sheet 10 again in the conveyance mechanical section 5, prints the reverse side of the sheet 10, and ejects the sheet 10 into the paper output tray 7.

The image forming section 2 has recording heads 24 mounted on a carriage 23 which is supported by a main guide member 21 and a secondary guide member 22 arranged horizontally and fixed between side plates 101L and 101R. The carriage 23 can slide in a main scanning direction. A carriage moving mechanism (not shown here) has a main scanning motor to drive the carriage 23 via a timing belt which is wrapped around and stretched between a driving pulley and a driven pulley.

The carriage 23 has attached recording heads 24*a* and 24*b* which are liquid discharge heads discharging ink droplets with colors yellow, magenta, cyan, and black. The recording heads 24*a* and 24*b* may be referred to as the "recording head 24" when distinction is not needed. The recording head 24 has an array of nozzles 124*n* (see FIG. 4) arranged in a secondary scanning direction, which is perpendicular to a main scanning direction so that droplets are to be discharged horizontally. Namely, a surface 124 with the nozzles 124*n* discharging droplets is arranged vertically, with which the recording head 24 discharges droplets in the horizontal direction.

Each of the recording heads 24*a*-24*b* has two lines of the nozzles 124*n* for discharging multiple droplets. The recording head 24*a* has a line of the nozzles 124*n* discharging yellow droplets and another line of the nozzles 124*n* discharging magenta droplets. The recording head 24*b* has a line of the nozzles 124*n* discharging black droplets and another line of the nozzles 124*n* discharging cyan droplets.

The carriage 23 also has attached head tanks 29 to supply ink of appropriate colors for the lines of nozzles 124*n*. The head tanks 29 receive ink from ink cartridges, or main tanks, provided for the colors, which can be easily attached to, or detached from the main body of the apparatus.

The sheets of paper 10 in the paper feed tray 4 are separated one by one with a paper feeding roller 43 and a separation pad 44. The sheet 10 is then fed into the main body of the apparatus, conveyed along a conveyance guide member 45 into a passage between a conveyance belt 51 and a pressing roller 48 in the conveyance mechanical section 5, held attracted to the conveyance belt 51, and conveyed further.

The conveyance mechanical section 5 includes a driving roller, or a conveying roller 52, a driven roller 53, the conveyance belt 51 wrapped around and stretched between the conveying roller 52 and the driven roller 53, a charging roller 54 to charge the conveyance belt 51, and a platen member 55 to keep flatness of the conveyance belt 51 at a place facing the image forming section 2. The conveyance belt 51 moves rotationally in a belt conveying direction, or the secondary scanning direction which is a direction in which the sheets 10 are conveyed.

The conveyance belt 51 is driven with rotational movement of the conveying roller 52 driven by a secondary scanning motor in a mechanical section for driving secondary scanning (not shown here) via a timing belt and a timing pulley.

The paper ejecting section 6 includes a guide member for ejecting paper 61, a conveying roller for ejecting paper 62, a spur 63, a paper ejection roller 64, and another spur 65. The paper ejecting section 6 ejects the sheets 10 onto which images are formed facedown to the paper output tray 7 through a nip between the paper ejection roller 64 and the spur 65.

The flipping section 8 is used for flipping the sheet 10 partially ejected to the paper output tray 7 with a switch back method and feeding the sheet 10 into a nip between the conveyance belt 51 and the pressing roller 48. The flipping section 8 has a switching nail 81 to switch a paper ejection passage and a paper flipping passage, a flipping guide member 82, a flipping roller 83, another flipping roller or a spur 84, a conveyance assisting roller 85 facing the driven roller 53, a reverse conveyance part (not shown here) of the conveyance belt 51, and a detour guide member 86 to detour the separated sheet 10 from the charging roller 54 and to guide the sheet 10 into the nip between the conveyance belt 51 and the pressing roller 48.

At one end of the scanning range of the carriage 23 out of a printing area, a maintenance and recovery mechanism 9 is provided to maintain and recover status of the nozzles 124*n* of the recording head 24.

A frame 90 of the maintenance and recovery mechanism 9 includes a suction cap 91 and a moisture retention cap 92 for capping the surface 124 with the nozzles 124*n* of the recording head 24, and a first wiper 94 for wiping the surface 124 with the nozzles 124*n*. The frame 90 also includes a second wiper 202, or a cleaning member, for cleaning and wiping a guide member of the recording head 24 as will be described later.

The suction cap 91 is held in a cap holder 93. The details will be described later. The suction cap 91 is connected to a suction and disposal passage 97 provided with a suction pump 96 as a suctioning means. The suction and disposal passage 97 communicates with a waste tank 98.

The wiper 94 is held in a wiper holder 194, which has projections on both sides in the main scanning direction of it. The projections fit on guiding gutters provided on wiping guides 195 arranged along a secondary scanning direction, with which the wiper 94 can be moved vertically, or in the direction where the nozzles of the recording head 24 are arrayed. The wiper 94 is moved downward to wipe the surface 124 with the nozzles 124*n* of the recording head 24, which is called vertical wiping.

A blank discharge receiver 95 is also provided to dispose of ink with increased viscosity by preventive or blank discharge of droplets, which is not done for actual image forming.

The frame 90 of the maintenance and recovery mechanism 9 has, in its inside, a stepping motor for a capping mechanism (not shown here). When the stepping motor for the capping mechanism makes forward rotation, via gears and cams (not shown in the figures), the cap holder 93 and the suction cap 91, and a cap holder (not shown in the figures) and the moisture retention cap 92, respectively execute capping and uncapping operations. When the stepping motor for the capping mechanism makes reverse rotation, the suction pump 96 is driven.

Another stepping motor is provided to drive a rack-and-pinion provided on the wiper holder 194 to drive the wiper 94. With forward or reverse rotation of the stepping motor, the wiper 94 is moved upward or downward.

As configured above, the image forming apparatus separates and feeds the sheets 10 from the paper feed tray 4 one by one. The separated sheet 10 is held electrostatically to the charged conveyance belt 51. The sheet 10 is conveyed vertically by circular movement of the conveyance belt 51. The image forming apparatus drives the carriage 23 and the recording head 24, in response to image signals, discharges ink droplets onto the suspended sheet 10 to record a line of image data, then conveys the sheet 10 with a predetermined length, records the next line and so on, and ejects the sheet 10 with recording completed to the paper output tray 7.

When executing maintenance and recovery operations of the nozzles 124*n* of the recording head 24, the image forming apparatus moves the carriage 23 to a position facing the maintenance and recovery mechanism 9. At that position, the recording head 24 may be capped with the suction cap 91 to suction and dispose of ink from the nozzles 124*n*, or may execute blank discharge of droplets, which does not contribute to image recording directly, but leads to stable discharge of droplets to form images.

When executing duplex printing, a first surface is printed as above and a second surface is printed as follows. When the rear end of the sheet 10 passes a switching point of the flipping section, or the switching nail 81, the paper ejection roller 64 is rotated backward, the sheet 10 is switched back, guided to the flipping guide member 82, conveyed through a nip between the flipping roller 83 and the spur 84, and fed into a nip between the reverse conveyance part of the conveyance belt 51 and the conveyance assisting roller 85.

The sheet 10 is held on the charged conveyance belt 51, conveyed with the rotational movement of the conveyance belt 51, separated from the conveyance belt 51 at the conveying roller 52, guided by the detour guide member 86 to go through a detour path, fed again into a nip between a forward conveyance part of the conveyance belt 51 and the pressing roller 48, held again on the conveyance belt 51, conveyed to the area for image forming with the recording head 24 to form images on the second surface, and ejected to the paper output tray 7.

Figure 3:
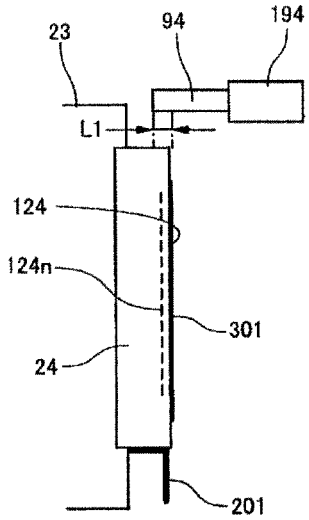
FIG. 3 is an explanatory side view illustrating a recording head and a wiper according to a first embodiment of the invention.
Figure 4:
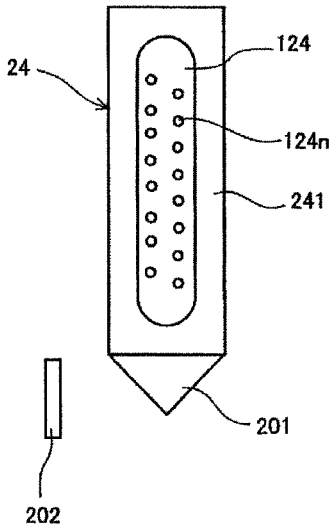
FIG. 4 is an explanatory elevation view illustrating the recording head and a cleaning member.

Next, a first embodiment of the invention will be explained with reference to FIG. 3 and FIG. 4. FIG. 3 is an explanatory side view illustrating a recording head 24 and a wiper 94. FIG. 4 is an explanatory elevation view illustrating the recording head 24 and a cleaning member 202.

The recording head 24 has two lines of nozzles 124*n* for discharging multiple droplets. The recording head 24 also has a nozzle cover 241 to cover a fringe of a surface 124 with the nozzles 124*n* and outer surfaces of the recording head 24.

The recording head 24 also has a guide member 201 attached at the lower end of the surface 124 with the nozzles 124*n* to have contact with the wiper 94. The guide member 201 has a shape tapered downward, or in the main scanning direction. The surface of the guide member 201 may be treated to be water-repellent, liquid-repellent, or ink-repellent.

Figure 5A:
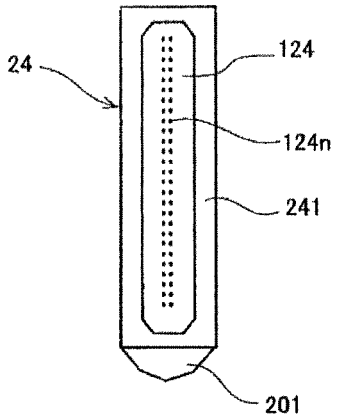
FIGS. 5A-5B are explanatory elevation views illustrating different examples of the recording head.
Figure 5B:
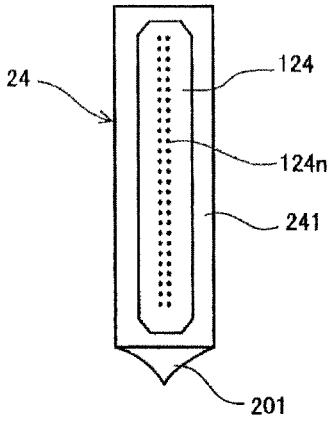

The guide member 201, as shown in FIG. 4, looks triangular when viewed from the front, or from the side facing the recording head 24. However the shape is not limited to it. The shape may be, as shown in FIG. 5A, a gradual tapered shape, or, as shown in FIG. 5B, a curved and tapered shape.

On the other hand, a main body 90 of the apparatus has the blade-shaped cleaning member 202 to wipe and clean the surface of the guide member 201. The cleaning member 202 wipes in a direction perpendicular to the direction in which the wiper 94 wipes, which is the main scanning direction in this example.

Wiping operations with the wiper 94 in the present embodiment as configured above will be explained with reference to FIGS. 6A-6D. FIGS. 6A-6D are explanatory side views illustrating wiping operations.

Figures 6A, 6B, 6C, 6D:
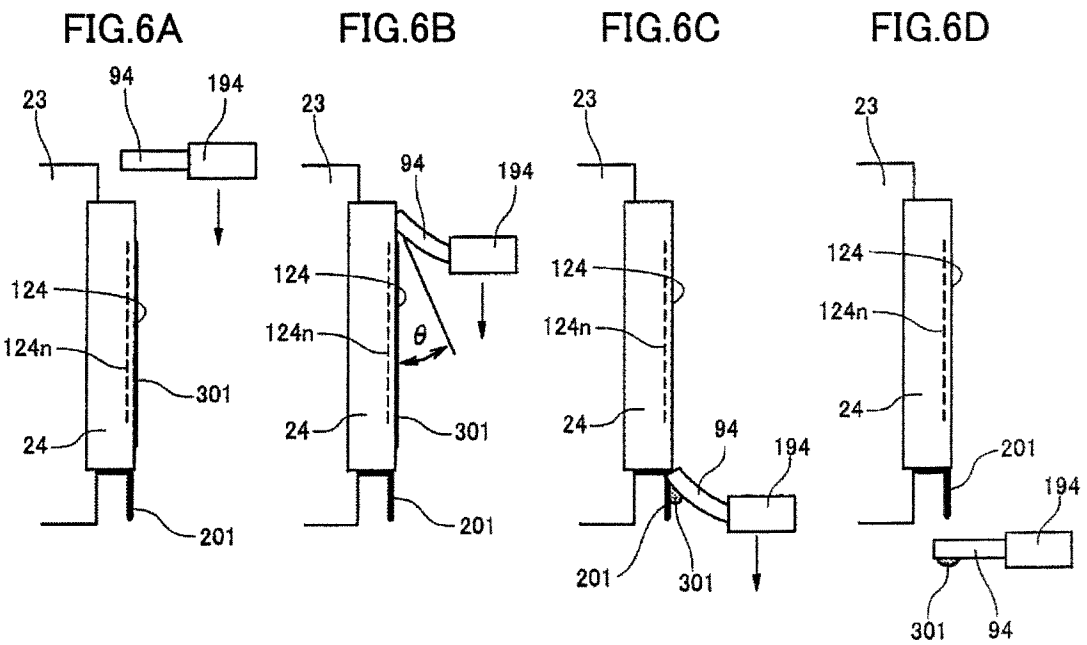
FIGS. 6A-6D are explanatory side views illustrating wiping operations with a wiper.

As shown in FIG. 6A, the wiper 94 is moved to a start position of wiping operations. At the start position, the tip of the wiper 94 is located leftward with respect to the surface 124 of the recording head 24. The horizontal distance between the tip of the wiper 94 and the surface 124 will be called the cut-in length L1 (see FIG. 3) hereafter.

With movement of a wiper holder 194, the wiper 94, as shown in FIG. 6B, moves downward, or in the direction denoted with an arrow, and wipes the surface 124 of the recording head 24 from top to bottom while scraping off residual liquid on the surface 124, called waste liquid 301.

After completing wiping the surface 124 of the recording head 24, as shown in FIG. 6C, the wiper 94 moves on downward to wipe the surface of the guide member 201.

Then, as shown in FIG. 60, the wiper 94 is separated from the surface of the guide member 201, and released from elastic deformation to recover the original shape.

It is noted that if waste liquid 301 splashes when the wiper 94 is recovering the original shape, a waste liquid receiver may be attached to the main body in advance to receive the splashing waste liquid 301.

The moving speed of the wiper is, for example, from 80 mm/s to 120 mm/s. If the moving speed is too slow, slippage may cause the waste liquid 301 to be left behind. If the moving speed is too fast, the wiper 94 may not cut into the nozzle holes enough, which may cause the waste liquid 301 to be left behind or dragged. The contact angle θ is adjusted with elastic force and the cut-in length of the wiper 94, which is set to 30 to 40 degrees. The surface 124 of the recording head 24 and the surface of the guide member 201 are wiped with the same conditions including the moving speed, the cut-in length, and the contact angle.

The guide member 201 has higher rigidity than the wiper 94, and may have elasticity. If the guide member 201 has lower rigidity than the wiper 94, the guide member 201 bends and the wiper 94 recovers the original shape. The guide member 201, on the contrary, scrapes off the waste liquid from the wiper 94.

Figure 7A:
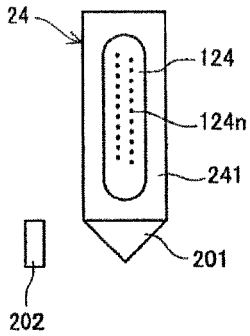
FIGS. 7A-7B are explanatory elevation and side views illustrating a cut-in length of a cleaning member when cleaning a guide member.
Figure 7B:
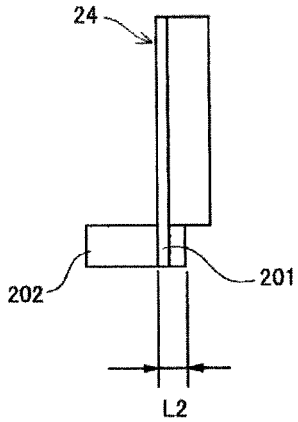
Figure 8A:
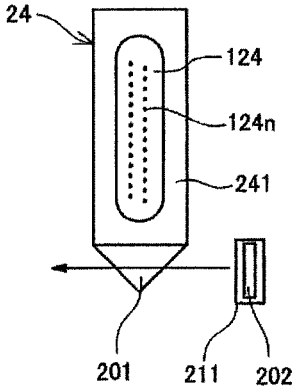
FIGS. 8A-8B are schematic views illustrating different operations of the cleaning member.
Figure 8B:
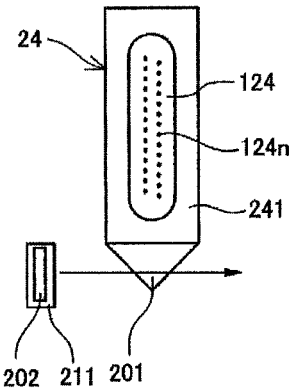

Next, cleaning operations for the guide member 201 with the cleaning member 202 will be explained with reference to FIG. 7A-7B and FIG. 8A-8B. FIGS. 7A-7B are explanatory elevation/side views illustrating cut-in length of the cleaning member 202 when cleaning the guide member 201. FIGS. 8A-8B are schematic views illustrating different operations of the cleaning member 202.

The cleaning member 202 is located in a position as shown in FIG. 7A so that the cleaning member 202 can have contact with the surface of guide member 201, which has been wiped with the wiper 94, with the cut-in length L2 when wiping the surface of the guide member 201.

The cleaning member 202 is held by a holder member 211 in the main body 90 of the apparatus, which provides a cleaning member moving mechanism (not shown here) to move the holder member 211 in the main scanning direction.

The cleaning member moving mechanism moves the cleaning member 202 in the main scanning direction, a direction perpendicular to the wiping direction of the wiper 94. In this case, the cleaning member 202 can be moved in either way as shown in arrows in FIGS. 8A-B.

With the movement of the cleaning member 202 relative to the guide member 201, the cleaning member 202 has contact with the surface of the guide member 201 to wipe and clean the surface of the guide member 201.

In this way, it is possible to remove residual waste liquid on the surface of the guide member 201 left as a result of wiping operations with the wiper 94, with the cleaning member 202.

As explained above, with providing the guide member 201 at the lower end of the recording head 24, it is possible to prevent wiped waste liquid from going around the lower end of the recording head 24 when wiping vertically the surface of the recording head 24. It is possible to prevent wiped waste liquid from dropping from the guide member 201 because waste liquid left behind with the wiper 94 is removed with the cleaning member 202.

Figure 9:
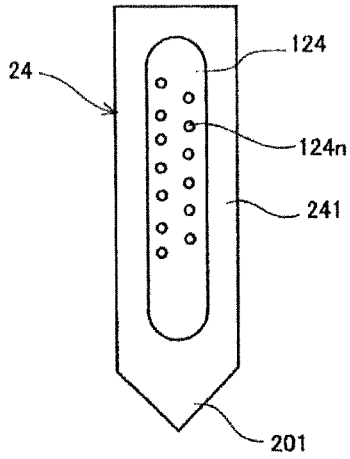
FIG. 9 is an explanatory elevation view of a recording head according to a second embodiment of the invention.

Next, a second embodiment of the invention will be explained with reference to FIG. 9. FIG. 9 is an explanatory elevation view of the recording head 24.

In the present embodiment, the recording head 24 has the nozzle cover 241 to cover a fringe of the surface 124 with the nozzles 124*n* and outer surfaces of the recording head 24. A part of the nozzle cover 241 forms the guide member 201.

In this way, the number of parts can be reduced. As the nozzle cover 241 of the recording head 24 and the surface of the guide member 201 are unified, there is no space between the recording head 24 and the guide member 201 for waste liquid to go into by capillary phenomenon.

Figure 10:
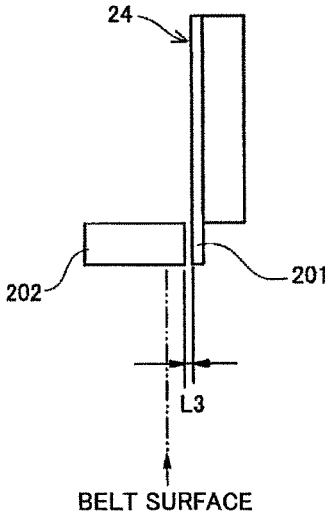
FIG. 10 is an explanatory side view of a recording head according to a third embodiment of the invention.

Next, a third embodiment of the invention will be explained with reference to FIG. 10. FIG. 10 is an explanatory side view of the recording head 24.

In the present embodiment, the cleaning member 202 does not have contact with the surface of the guide member 201 when wiping and removing residual waste liquid on the guide member 201. Namely, the cut-in length L2 is less than zero.

In this case, the cleaning member 202 does not need to be made of elastic material. Also, by positioning the cleaning member 202 in such a way that the distance between the tip of the cleaning member 202 and the surface of the guide member 201, L3, is smaller than the distance between the surface of the recording head 24 and the surface of the conveyance belt 51, it is possible to prevent waste liquid sticking to the surface of the guide member 201 from touching the sheet 10.

Also, the surface of the cleaning member 201 may be treated to be hydrophilic, liquid-philic, or ink-philic so that waste liquid can be transferred from the surface of the guide member 201 to the cleaning member 202 more easily. Alternatively, by making the surface of the cleaning member 202 of water-absorbing or waste-liquid-absorbing material, waste liquid can be transferred from the surface of the guide member 201 to cleaning member 202 more easily.

Figure 11A:
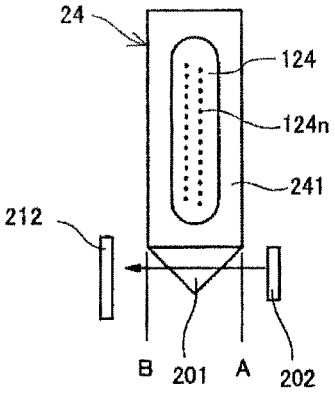
FIG. 11A is an explanatory elevation view of a recording head according to a fourth embodiment of the invention.
Figure 11B:
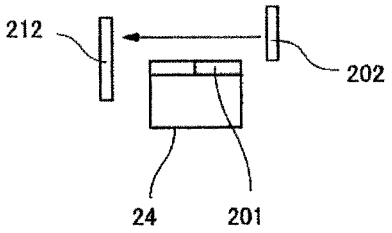
FIG. 11B is an explanatory bottom view of the recording head.

Next, a fourth embodiment of the invention will be explained with reference to FIGS. 11A-11B. FIG. 11A is an explanatory elevation view of the recording head 24, and FIG. 11B is an explanatory bottom view of it.

In the present embodiment, a liquid receiver 212 is provided at a position opposite to the start position of the cleaning member 202 with respect to the position of the recording head 24, along the movement path of the cleaning member 202.

When the cleaning member 202 wipes the guide member 201 while contacting it, the cleaning member 202 has a first contact with the guide member 201, for example, at a position "A", then deforms itself with it own elasticity to wipe waste liquid sticking to the surface of the guide member 201. Then, at a position "B", the cleaning member 202 is separated from the guide member 201, and recovers its original shape with elastic restoring force, which may splash waste liquid transferred to the cleaning member 202.

By providing the liquid receiver 212 close to the terminal position of wiping operations with the cleaning member 202 to receive splashing waste liquid, it is possible to prevent waste liquid from splashing beyond the liquid receiver 212. It is noted that the waste liquid received by the liquid receiver 212 may be absorbed by absorbing material, or gathered by a scraper.

Figure 12A:
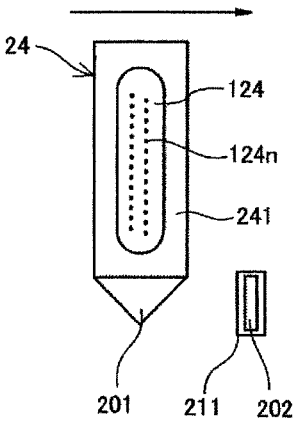
FIGS. 12A-12B are explanatory elevation views of a recording head according to a fifth embodiment of the invention.
Figure 12B:
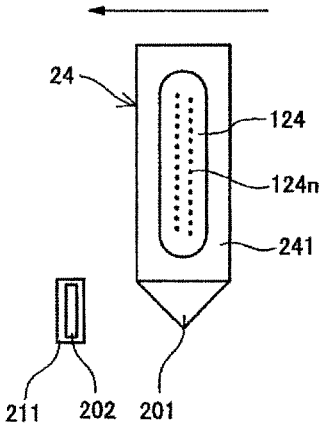

Next, a fifth embodiment of the invention will be explained with reference to FIGS. 12A-12B. FIGS. 12A-12B are explanatory elevation views of the recording head 24.

In the present embodiment, the cleaning member 202 is fixed to the main body 90 of the apparatus.

In this case, by moving the carriage 23 in the directions shown with arrows in FIG. 12A or 12B, which is the main scanning direction, the cleaning member 202 is moved relative to the guide member 201 so that the cleaning member 202 wipes and cleans the surface of the guide member 201.

In this way, a moving mechanism of the cleaning member 202 is eliminated to make the configuration simpler.

Figure 13A:
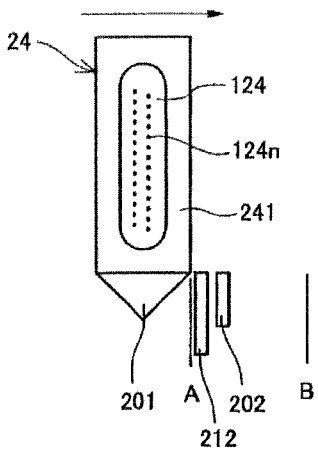
FIG. 13A is an explanatory elevation view of a recording head according to a sixth embodiment of the invention.
Figure 13B:
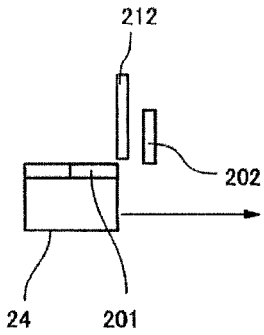
FIG. 13B is an explanatory bottom view of the recording head.

Next, a sixth embodiment of the invention will be explained with reference to FIGS. 13A-13B. FIG. 13A is an explanatory elevation view of the recording head 24, and FIG. 13B is an explanatory bottom view of it.

In the present embodiment, a liquid receiver 212 is provided at a position close to the terminal position of wiping operations with the cleaning member 202 to receive splashing waste liquid.

When the cleaning member 202 wipes the guide member 201 with contacting it, the cleaning member 202 has a first contact with the guide member 201, for example, at a position "A", then deforms itself with it own elasticity to wipe waste liquid sticking to the surface of the guide member 201. Then, at a position "B", the cleaning member 202 is separated from the guide member 201, and recovers its original shape with elastic restoring force, which may splash waste liquid scraped by the cleaning member 202.

By providing the liquid receiver 212 close to the terminal position of wiping operations with the cleaning member 202 to receive splashing waste liquid, it is possible to prevent waste liquid from splashing beyond the liquid receiver 212.

In this case, the liquid receiver 212 may be fixed at a position away from the cleaning member 202 by a distance greater than the width between the recording head 24 and the cleaning member 202. Alternatively, the liquid receiver 212 is fixed to the carriage 23 to be moved with the recording head 24.

It is noted that in the invention, "sheets" is not limited to sheets made of paper, but meant to be material onto which ink droplets or other liquid can be discharged, including OHP sheets, cloth, glass, substrate, etc. "Sheets" also includes materials called media for recording, recording media, recording paper, recording sheet and the like. Also, image forming, recording, character printing, photo printing, printing are treated as synonyms.

Also, an "image forming apparatus" is meant to be an apparatus configured to form images by discharging liquid onto media such as paper, strings, fiber, cloth, leather, metals, plastic, glass, wood, ceramics and the like. Also, "image forming" means not only to form images having meanings such as characters, figures and the like onto media, but to form images without patterns or meanings onto media, such as just discharging droplets onto media.

Also, if not specified, "ink" is not limited to so-called ink. The term "ink" is used as a generic term to mean any kind of liquid which can be used for image forming such as recording liquid, fixing liquid, liquid and the like. "Ink" may be, for example, DNA samples, photoresist, patterning material, resin or the like.

Also, an "image" is not limited to a planar image, but an image formed onto a three dimensional object, or a three dimensional object itself formed in three dimensional space.

Also, although, in the above embodiments, sheets are conveyed vertically, and droplets are discharged horizontally, the invention is applicable to configurations in which sheets are conveyed in a slant direction with respect to the vertical direction, or droplets are discharged in a slant direction with respect to the horizontal direction.

Further, the present invention is not limited to these embodiments, but various variations and modifications may be made without departing from the scope of the present invention.

The present application is based on Japanese Priority Application No. 2012-018352, filed on Jan. 31, 2012, with the Japanese Patent Office, the entire contents of which are hereby incorporated by reference.

What is claimed is:

1. An image forming apparatus comprising:

a recording head with multiple nozzles on a surface of the recording head to discharge droplets, the surface with the nozzles facing in a direction that is approximately horizontal;

a wiper to wipe the surface with the nozzles of the recording head from top to bottom;

a guide member attached to the recording head at a lower end of the surface with the nozzles, to have contact with the wiper; and a cleaning member attached to a main body of the apparatus to clean the guide member, wherein the recording head has a nozzle cover configured to cover a fringe of the surface with the nozzles and outer surfaces of the recording head, and a part of the nozzle cover forms the guide member having a plate shape extending in a downward direction from the lower end of the surface with the nozzles, wherein a bottom part of the guide member has a pointed tip tapered downward so that the width of the guide member gradually decreases, and wherein the cleaning member is a member configured to wipe a surface of the guide member, and a wiping direction of the cleaning member is parallel to the surface of the recording head with the nozzles, the wiping direction of the cleaning member being a lateral direction perpendicular to a vertical direction.

2. The image forming apparatus as claimed in claim 1, wherein the wiping direction of the cleaning member is perpendicular to a wiping direction of the wiper.

3. The image forming apparatus as claimed in claim 1, wherein as the cleaning member wipes residual liquid on the surface of the guide member, a gap is present between the cleaning member and the surface of the guide member so that the cleaning member wipes the residual liquid on the surface of the guide member without the cleaning member contacting the surface of the guide member.

4. The image forming apparatus as claimed in claim 1, wherein the cleaning member wipes residual liquid on the surface of the guide member while having contact with the surface of the guide member, and a liquid receiver to receive splashing liquid from the cleaning member is provided at a position in vicinity of a terminal end of wiping movement of the cleaning member.

5. The image forming apparatus as claimed in claim 1, wherein the cleaning member is fixed to a main body of the apparatus, and a carriage carrying the recording head is moved to clean the surface of the guide member with the cleaning member.

* * * * *